United States Patent [19]

Estes et al.

[11] 4,392,946

[45] Jul. 12, 1983

[54] HYDRODESULFURIZATION OF HYDROCARBONS WITH FLUORIDED PLATINUM

[75] Inventors: John H. Estes, Wappingers Falls; Sheldon Herbstman, Spring Valley, both of N.Y.

[73] Assignee: Texaco Inc., White Plains, N.Y.

[21] Appl. No.: 330,108

[22] Filed: Dec. 14, 1981

[51] Int. Cl.[3] ..... C10G 45/10

[52] U.S. Cl. ..... 208/217; 208/208 R

[58] Field of Search ..... 208/217, 213, 208 R

[56] References Cited

U.S. PATENT DOCUMENTS

| | | | |
|---|---|---|---|
| 2,916,443 | 12/1959 | Riordan et al. | 208/217 |
| 3,050,571 | 8/1962 | Fleming et al. | 208/217 |
| 3,116,234 | 12/1963 | Douwes et al. | 208/208 R |
| 3,173,853 | 3/1965 | Peralta | 208/89 |
| 3,580,837 | 5/1971 | Pollitzer | 208/57 |
| 3,709,817 | 1/1973 | Suggitt et al. | 208/112 |
| 3,720,602 | 3/1973 | Riley et al. | 208/216 R |
| 3,756,941 | 9/1973 | Carter et al. | 208/135 |

FOREIGN PATENT DOCUMENTS

| | | | |
|---|---|---|---|
| 482882 | 4/1952 | Canada | 208/217 |
| 539418 | 4/1957 | Canada | 208/217 |

*Primary Examiner*—Delbert E. Gantz
*Assistant Examiner*—O. Chaudhuri
*Attorney, Agent, or Firm*—Carl G. Ries; Robert A. Kulason; Martin M. Glazer

[57] ABSTRACT

A process for the desulfurization of a hydrocarbon fraction having unsaturated hydrocarbons and sulfur compounds comprising the steps of contacting the hydrocarbon fraction with hydrogen gas and a fluorided platinum catalyst in the presence of an oxygen-containing hydrogenation moderator which is either water or an oxygen-containing material which is hydrogenatable to water and whose hydrogenation products will not poison the platinum catalyst. The oxygen-containing hydrogenation moderator should be present in sufficient quantity to substantially prevent the saturation of the unsaturated hydrocarbons without seriously affecting the desulfurization of the hydrocarbon fraction. A preferred oxygen-containing hydrogenation moderator is carbon monoxide.

15 Claims, No Drawings

HYDRODESULFURIZATION OF HYDROCARBONS WITH FLUORIDED PLATINUM

BACKGROUND OF THE INVENTION

1. Field of the Invention

This invention relates to a process for the hydrodesulfurization of hydrocarbons with a fluorided platinum catalyst and more particularly to the use of an oxygen-containing hydrogenation moderator to lower the saturation of unsaturated hydrocarbons by the hydrodesulfurization process.

2. The Prior Art

Unleaded gasolines contain some sulfur, generally as organo-sulfur compounds, whose concentration varies with the source and prior processing of the gasolines. The catalytic treatment of the exhaust gases from internal combustion engines using sulfur-containing unleaded gasolines produces sulfur oxides. For various reasons it may be desirable to reduce the sulfur oxides emissions. One method of accomplishing this is by reducing the sulfur content of the unleaded gasolines.

The use of a cobalt-molybdenum catalyst on alumina, or the use of a nickel catalyst, to desulfurize gasoline is known in the art but is an expensive process. Such catalysts require high pressures and large quantities of generally expensive catalytic material. The use of high pressures requires special high pressure hydrogenation equipment which is itself expensive and is also expensive to operate.

The use of platinum as a catalyst for desulfurization was previously thought to be impossible due to the rapid deactivation of the platinum catalyst by sulfur and sulfur compounds. It recently has been found that a highly fluorided platinum catalyst retains some resistance to sulfur poisoning so that such a catalyst can be used for the desulfurization of a feedstock.

The fluorided platinum catalyst and the process for using it are disclosed in U.S. Pat. No. 3,435,085. In the disclosed process, hydrocarbons or other feedstocks are desulfurized by contacting the feedstock with hydrogen in the presence of the fluorided platinum. However, the fluorided platinum also catalyzes the hydrogenation of unsaturated hydrocarbons to saturated hydrocarbons. Such saturation is undesirable in unleaded gasolines since the saturation of multiple carbon bonds lowers the octane number of the gasolines. Gasolines of a higher octane number are more desirable in internal combustion engines because of their antiknock properties. Further, the hydrogenation process disclosed in U.S. Pat. No. 3,345,085 requries the use of hydrogen at very high pressures, such as 83 kilograms per square centimeter (1200 psia) and preferably between 69 and 277 kilograms per square centimeter (1000 to 4000 psia). Such pressures are costly to use because, for among other reasons, the equipment required for hydrogenation at such pressures is costly to build and maintain.

Fluorided platinum has been found to be useful in the selective hydrogenation of polycyclic aromatics, such as disclosed in U.S. Pat. No. 3,285,984. A low pressure, 6.9 to 34.6 kilograms per square centimeter, hydrogenation process using a fluorided platinum catalyst is disclosed in U.S. Pat. No. 2,757,128, however, it is disclosed that the saturation of olefins occurs.

Coassigned U.S. Pat. No. 3,711,566, discloses the low pressure hydrogenation of aromatic hydrocarbons in the presence of sulfur using a fluorided platinum catalyst. Very small quantities, in the order of about $2.5\times10^{-5}$ to $1.0\times10^{-3}$ gram mole of carbon monoxide per hour per gram of the fluorided platinum alumina catalyst as disclosed as being used to inhibit hydrocracking reactions.

Coassigned U.S. Pat. No. 3,711,399 discloses a process for the selective hydrocracking and isomerization of hydrocarbon feedstocks with hydrogen and a small quantity of carbon monoxide. The disclosed process converts paraffin hydrocarbons, having at least 6 and up to 40 carbon atoms to hydrocarbons having considerable branching. However, the process is only disclosed as being useful for paraffins which already are completely saturated.

Coassigned U.S. Pat. No. 3,756,941 discloses the dehydroisomerization of alkylcyclopentanes, gasoline and naphtha fractions into aromatic compounds by the use of a catalyst and a process similar to that disclosed in the two previously cited patents. Again a very small quantity of carbon monoxide is used, and it is used to reduce the cracking property of the fluorided platinum catalyst. No mention is made of preventing the saturation of unsaturated hydrocarbons and of desulfurization.

In coassigned U.S. Pat. Nos. 3,711,566; 3,711,399, and 3,756,941, cited above, it is disclosed that the beneficial effects provided by the carbon monoxide is unexpected in as much as carbon monoxide has long been considered a strong general poison to platinum metal catalysts. Further, the quantities of carbon monoxide disclosed as being useful are very small, being no greater than about $1\times10^{-3}$ gram mole of carbon monoxide per hour per gram of fluorided platinum alumina catalyst. In all of the cited prior art there is no disclosure that the saturation of multiple carbon bonds is prevented or is reduced in any way by the presence of the carbon monoxide.

SUMMARY OF THE INVENTION

It now has been discovered that a hydrocarbon fraction having sulfur compounds and unsaturated hydrocarbons can be desulfurized by a low pressure hydrogenation process using a fluorided platinum catalyst and water as a hydrogenation moderator. The water is preferably formed in situ during the hydrogenation process from an oxygen-containing material which is hydrogenatable to water and whose hydrogenation products will not poison the platinum catalyst. Water or the oxygen-containing material which is hydrogenated to water must be present in a sufficient quantity to prevent the saturation of substantially all of the unsaturated hydrocarbons by the desulfurization process. The saturation of multiple carbon bonds has been found to occur without the use of sufficiently large quantities of hydrogenation moderator. Useful oxygen-containing materials include: carbon monoxide, carbon dioxide, and oxygen. Oxygen-containing materials which contain catalyst poisons, such as nitrogen or nitrogen compounds, cannot be used in the process of the present invention since such materials will poison the catalyst and prevent the desulfurization process from properly proceeding.

PREFERRED EMBODIMENT OF THE INVENTION

The preferred process of the present invention comprises a process for the hydrogen desulfuriation of a hydrocarbon fraction, such as a light fluid cracked naphtha, which contains sulfur compounds and unsaturated hydrocarbons. The process comprises the steps of contacting the hydrocarbon fraction with hydrogen gas and a fluorided platinum catalyst in the presence of an oxygen-containing hydrogenation moderator which is either water or preferably an oxygen-containing material which is hydrogenatable to water and whose hydrogenation products will not poison the platinum catalyst. The use of a sufficient quantity of the hydrogenation moderator is necessary to prevent the saturation of substantially all of the unsaturated hydrocarbons without substantially preventing the desulfurization of the hydrocarbon fraction.

The preferred oxygen-containing material comprises carbon monoxide which can comprise from about 1 percent to about 30 percent by volume of a total volume of hydrogen and carbon monoxide gas used in the process of the present invention. Preferably the volume of carbon monoxide varies from about 1 to about 10 percent of the combined volume of carbon monoxide and hydrogen used in the desulfurization process.

The carbon monoxide or other useful oxygen-containing material should be present in the process at the rate of from about $3.9\times10^{-3}$ to about $2.4\times10^{-1}$ gram mole per hour of oxygen-containing material per gram of catalyst. Preferably the carbon monoxide is present at the rate of from about $3.9\times10^{-3}$ to about $7.9\times10^{-2}$ gram mole of carbon monoxide per hour per gram of catalyst. When expressed in terms of gram mole per hour of oxygen-containing material per gram of catalytic material, this range can be from about 1.3 to about 79 gram moles per hour per gram of platinum in the catalyst, with the preferred range being from about 1.3 to about 26 gram moles per hour per gram of platinum.

When oxygen-containing materials are used which contain more than one atom of oxygen per mole of oxygen-containing material, such as carbon dioxide, the above ranges are divided by the number "n" of atoms of oxygen in the oxygen-containing material. For example, if carbon dioxide is used as the oxygen-containing material, then all the above ranges are divided by 2, which represents the number of oxygen atoms in each molecule of carbon dioxide.

Desulfurization of the hydrocarbon feedstock can proceed at temperatures of from about 150° C. to 425° C., preferably from about 260° C. to 400° C. Desulfurization can proceed at liquid hourly space velocities of from about 1 to 10 v/v/hr, preferably from about 3 to 5 v/v/hr. The hydrogenation, significantly, can be successfully conducted at low pressures from about 3 atmospheres to about 34 atmospheres (about 44 to 500 psi), preferably between about 6 to 14 atmospheres (about 90 to 200 psi). Such low pressures permit the desulfurization process to be undertaken with conventional hydrogenation equipment and alleviates the high investments associated with high pressure reactors and equipment. The quantity of hydrogen used for the hydrogenation process can vary from about 0.01 cubic meter per hour per LHSV to about 0.1 cubic meter per hour per LHSV, preferably the quantity of hydrogen varies from about 0.03 to about 0.07 cubic meters per hour per LHSV.

The catalyst employed in the process of the present invention comprises from about 0.05 to about 10 percent platinum by weight on alumina, preferably from about 0.1 to about 1 percent by weight. Optionally, the catalyst may contain other metals such as from about 0.05 to 1 percent rhenium or tin by weight of the catalyst. Further, the catalyst contains from about 0.5 to 15 percent fluorine by weight of the catalyst, preferably from about 0.5 to about 2 percent fluorine by weight.

The platinum is preferably on an alumina base. The alumina can have a surface area of anywhere from about 50 to about 400 square meters per gram. The alumina can be anyone of the useful alumina catalyst supports such as eta, gamma, or silica established alumina with eta and gamma-aluminas being preferred.

The catalyst useful in the present invention can be prepared by methods known in the art. The platinum component of the catalyst can be applied to the alumina by impregnating it with a soluble platinum salt, followed by calcination at temperatures from about 300° C. to about 600° C. for several hours. The platinum alumina catalyst is contacted with a fluoriding agent, such as an aqueous hydrogen fluoride, vaporized boron or ammonium fluoride, or treatment with other well-known fluoriding compound, such as carbon tetrafluoride or sulfur tetrafluoride, thereby introducing to the catalyst a chemically combined fluorine.

The presence of water, whether originally introduced or formed in situ from an oxygen-containing material, on the surface of the catalyst is believed to inhibit the cracking activity and the saturation of multiple carbon to carbon bonds by the catalyst during hydrodesulfurization. The large concentration of the oxygen-containing hydrogenation moderator required in the present invention produces sufficient water to reduce the multiple bond saturating capabilities of the fluorided platinum catalyst. A severe reduction in the hydrogenation moderator in the process of the present invention results in the saturation of multiple carbon to carbon bonds, while the complete removal of the hydrogenation moderator from the process of the present invention, also causes substantial hydrocracking of the feedstock.

Certain oxygen-containing materials, such as the oxides of carbon are preferred, since the products of the hydrogenation of such materials are water and methane. The use of other oxygen-containing materials in the feedstock must be examined as to each particular material since by-products of the hydrogenation of such materials should not poison the catalyst. Since it is known that nitrogen containing compounds can poison platinum catalysts, the oxygen-containing materials useful in the present invention should not contain sufficient nitrogen to effectively poison the platinum catalyst.

A useful feedstock for the process of the present invention is a light fluid cracked naphtha which has a sulfur content of from about 200 to about 1000 parts per million, an olefin content from about 10 to 30 volume percent, and an aromatic content from about 10 to 20 volume percent. Such desulfurized feedstocks can be subsequently used for unleaded gasolines.

The process of the present invention acts to remove sulfur from the feedstocks by forming volatile sulfur compounds, such as hydrogen sulfide ($H_2S$) which are much more readily removed from the feedstocks than the sulfur compounds originally found therein. If the sulfur compounds remain in the feedstocks which are subsequently used as gasoline, the exhaust gases of internal combustion engines using the gasoline will generate sulfur oxides which have unpleasant odors and whose emission may be restricted in the future. The process of the present invention can also be used to desulfurize other hydrocarbon feedstocks containing aromatics and multiple bonds where it is desirable to desulfurize the feedstocks without saturating the multiple bonds and the aromatics. Hydrodesulfurization by the process of the present invention, because of the low pressures involved, is found to be lower in cost than other processes. Further, the catalyst used in the present invention is far more efficient than the catalysts previously used for desulfurization processes thus requiring less of the costly catalysts. Lower catalyst costs make the process of the present invention considerably cheaper than other desulfurization processes.

The present invention will be more fully understood from the following examples which are not meant to limit the invention in any way.

EXAMPLE 1

A feedstock which comprised a light fluid cracked naphtha, and contained about 240 parts per million sulfur, had a bromine number of 41.2, an aromatics content of about 13.0 volume percent per the FIA method, an olefins content of about 24.5 volume percent, a saturated component content of about 62.5 volume percent, a micro research octane number of 86.1, and a machine octane number of about 77.8, was hydrogenated at a rate of about 2.94 LHSV in a continuous flow hydrogenation apparatus containing about 16 grams of a fluorided platinum catalyst. The catalyst comprised about 0.3 weight percent platinum, about 0.2 weight percent rhenium and about 2 weight percent fluorine on a gamma alumina base. The catalyst had a surface area of about 184 square meters and had a volume of about 34 cubic centimeters. The charge was hydrogenated at a temperature of about 400° C. and at a pressure of about 13.8 kilograms per square centimeter using about $3.75\times10^{-2}$ standard cubic meter of hydrogen gas (measured at standard pressure and temperature). No oxygen-containing hydrogenation moderator was added. The desulfurized naphtha from the process contained about 20 ppm sulfur (91.7 percent desulfurization) and about 13 volume percent aromatics, however, there was only about 1 percent by volume olefins, and the saturated compounds made up about 86 percent of volume of the desulfurized naphtha. The bromine number had dropped to 1.5, the research octane number had decreased to about 72.5, a loss of about 13.6, while the motor octane had dropped to about 68.9 a loss of about 8.9.

EXAMPLE 2

The feedstock of Example 1 was hydrogenated as in Example 1, however, about $1.5\times10^{-3}$ standard cubic meter per hour of carbon monoxide (CO) was also introduced into hydrogen gas stream. The added carbon monoxide represented about 3.2 volume percent of the hydrogen gas and carbon monoxide gas in the stream. The naphtha, after being desulfurized by the process, contained about 40 parts per million sulfur, which represented an 83.3 percent desulfurization, and had about the same volume percent of aromatics. However, there was about 10.5 percent by volume olefins instead of the about 1 percent produced without the added carbon monoxide, and the saturated compounds made up only about 76 percent by volume of the desulfurized naphta. The bromium number had dropped to 8.2, the research octane number had decreased to about 79.0, a drop of about 7.1 versus a drop of 13.6 without the use of carbon monoxide, and the motor octane number had dropped to about 74.0, a drop of 3.8 as compared to the 8.9 drop when hydrogenation was accomplished without the use of an oxygen containing moderator.

EXAMPLE 3-5

The hydrogenation process of Example 2 is carried out using water, carbon dioxide, or pure oxygen, the latter two at half the volume of carbon monoxide used in Example 2, as the hydrogenation moderator instead of the carbon monoxide used in Example 2. The use of these other oxygen-containing gases, which do not produce compounds which can poison the platinum catalyst, are found to be effective moderators in reducing the degree of saturation of double bonds during the hydrogen desulfurization of the sulfur containing feedstock using the fluorided platinum catalyst.

From the above examples it can be seen that the use of an oxygen-containing hydrogenation moderator in a hydrogen desulfurization process, does not seriously reduce the effectiveness of the desulfurization process, but it does reduce the tendency of the hydrogenation process to saturate double bonds which reduces the octane number of the hydrocarbon feedstock.

The above examples are not meant to limit the invention in any way which invention is set forth in the following claims.

What is claimed is:

1. A process for the hydrogen desulfurization of a hydrocarbon fraction comprising olefinic, aromatic and sulfur compounds comprising the step of contacting said hydrocarbon fraction with hydrogen gas and a fluorided platinum catalyst in the presence of an oxygen-containing hydrogenation moderator selected from the group consisting of water, and oxygen-containing materials which are hydrogenatable to water and whose hydrogenation products will not poison the platinum catalyst, said hydrogenation moderator being present in a quantity sufficient to minimize the saturation of the olefinic and aromatic compounds by the hydrogen gas and the fluorided catalyst.

2. The process of claim 1 wherein said hydrogenation moderator comprises from about 1/n percent to about 10/n percent by volume of the volume of the hydrogen and said hydrogenation moderator, wherein n equals the number of oxygen atoms in said hydrogenation moderator.

3. The process of claim 1 wherein said hydrogenation moderator contacts said hydrocarbon fraction at the rate from about $(3.9\times10^{-3})/n$ to about $(2.4\times10^{-1}/n)$ gram mole of hydrogenation moderator per hour per gram of said catalyst, wherein n equals the number of oxygen atoms in said hydrogenation moderator.

4. The process of claim 3 wherein said hydrogenation moderator contacts said hydrocarbon fraction at the rate of from about $3.9\times10^{-3}/n$ to about about $7.9\times10^{-2}/n$ gram mole of hydrogenation moderator per hour per gram of said catalyst.

5. The process of claim 1 wherein said hydrogenation moderator is contacted with said hydrocarbon fraction at the rate of from about 1.3/n to about 79/n gram moles of said hydrogenation moderator per hour per gram of platinum on said catalyst, wherein n is equal to the number of oxygen atoms in said hydrogenation moderator.

6. The process of claim 5 wherein said hydrogenation moderator is contacted with said hydrocarbon fraction at the rate of from about 1.3/n to about 26/n gram moles of hydrogenation moderator per hour per gram of platinum on said catalyst.

7. The process of claim 1 wherein the oxygen-containing materials are selected from the group consisting of carbon monoxide, and carbon dioxide.

8. The process of claim 1 wherein said hydrocarbon fraction is contacted with said hydrogen gas and said hydrogenation moderator at a pressure of from about 6 to about 14 atmospheres.

9. The method of claim 1 wherein said catalyst comprises from about 0.05 to about 1 percent of platinum by weight, and from about 0.5 to about 15 percent fluorine by weight on alumina.

10. The process of claim 9 wherein said catalyst further comprises from about 0.5 to about 1 percent rhenium by weight.

11. The process of claim 1 wherein the liquid hourly space velocity of said hydrocarbon fraction comprises from about 1 to about 10 v/v/hour.

12. The process of claim 11 wherein the liquid hourly space velocity of said hydrocarbon fraction comprises from about 3 to about 5 v/v/hour.

13. The process of claim 1 wherein sulfur comprises from about 200 to about 1000 parts per million by weight of said hydrocarbon fraction.

14. The process of claim 1 wherein the olefinic and aromatic compounds comprise from about 10 to about 30 percent by volume of said hydrocarbon fraction.

15. The process of claim 1 wherein said hydrocarbon fraction comprises a light fluid cracked naphtha having a sulfur content of from about 200 to about 1000 parts per million by weight and an olefinic and aromatic compounds content of from about 10 to 30 percent by volume.

* * * * *